US006805351B2

(12) United States Patent
Nelson

(10) Patent No.: US 6,805,351 B2
(45) Date of Patent: Oct. 19, 2004

(54) LAWSUIT BOARD GAME

(76) Inventor: Tina Rae Eskreis Nelson, 30 W. 60th St., Apt. 5U, New York, NY (US) 10023

( * ) Notice: Subject to any disclaimer, the term of this patent is extended or adjusted under 35 U.S.C. 154(b) by 0 days.

(21) Appl. No.: 10/301,193

(22) Filed: Nov. 21, 2002

(65) Prior Publication Data

US 2004/0100023 A1 May 27, 2004

(51) Int. Cl.[7] ..... A63F 3/00

(52) U.S. Cl. ..... 273/257; 273/256; 273/278; 273/279

(58) Field of Search ..... 273/236, 243, 273/256, 278, 279, 257

(56) References Cited

U.S. PATENT DOCUMENTS 4,012,045 A * 3/1977 Vail ..... 273/257
4,039,192 A * 8/1977 Magiera ..... 273/257
4,045,031 A * 8/1977 Arnold ..... 273/257
4,068,848 A * 1/1978 Lichtman et al. ..... 273/257

FOREIGN PATENT DOCUMENTS

FR 2619020 A1 * 2/1989 ..... A63F/3/00
GB 2197211 A * 5/1988 ..... A63F/3/00

* cited by examiner

*Primary Examiner*—Vishu K. Mendiratta
(74) *Attorney, Agent, or Firm*—Notaro & Michalos PC

(57) ABSTRACT

An educational, legal based game and method for players, has a board with spaces on which the players land. The spaces instruct players to bring a simulated lawsuit or to act as a result of a simulated circumstance associated with the legal profession. A fund of play money is provided and a random generator determines the number spaces the players will move. Lawsuit cards are part of the game, each having a fact pattern and a positive or negative monetary result. At a player's option, an appeal card can be selected but then the player must comply with the monetary result which may be higher or lower on the appeal card. A player landing on one of the other type of spaces acts in accordance with the simulated circumstance of that space.

9 Claims, 1 Drawing Sheet

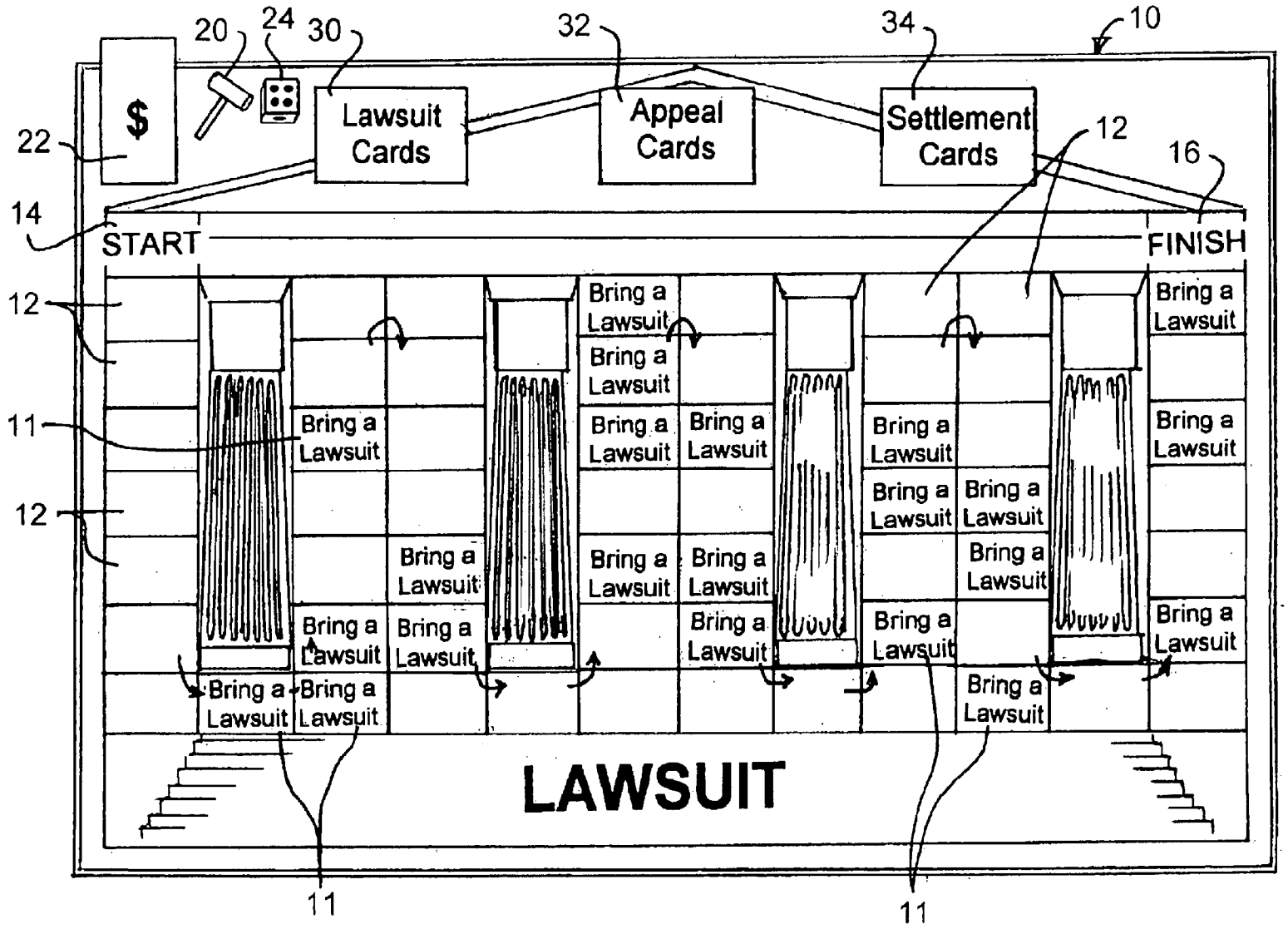
10
16
FINISH
12
Settlement Cards
34
Appeal Cards
32
Lawsuit Cards
30
24
20
$
22
START
14
12
11
12
Bring a Lawsuit
LAWSUIT
11
11

LAWSUIT BOARD GAME

FIELD AND BACKGROUND OF THE INVENTION

The present invention relates generally to the field of board games, and in particular, to a new, useful and educational board game and method based on legal disputes and their resolution.

When asked what they want to be when they grow up, children are often heard to answer "I want to be a lawyer or a doctor." Especially for young children, this usually means nothing more than wanting be like mom, or like dad, or like someone else they know or have heard about. Children rarely understand what it means to practice law or to be a lawyer.

One tool that is particularly useful as a teaching aide is a game. As will be clear from the following, one object of the present invention is to use the mechanism of a board game to help teach children and others what it is like to be an attorney who is involved in litigation.

The following U.S. patent classifications are relevant to the present invention:

| Class | Subclasses |
|---|---|
| 273 | 236, 256, 257, 297 |
| D21 | 334, 350, 351 |

Pertinent patents found in these classifications are:

| U.S. Pat. No. | Inventor(s) |
|---|---|
| 2,026,082 | Darrow |
| 3,850,433 | Purlia |
| 3,966,211 | Brown |
| 4,012,045 | Vail |
| 4,032,154 | Magiera |
| 4,039,192 | Magiera |
| 4,068,848 | Lichtman et al. |
| 4,706,960 | Nowacki et al. |
| 6,189,886 | Moran |
| 6,371,848 | Ashby |
| 6,416,055 | Shaw, Sr. |

The quintessential board game with legal features such as the concept of deeds of ownership, mortgages and the like, is the game of MONOPOLY. See U.S. Pat. No. 2,026,082 to Darrow.

A board game for teaching the fundamentals of constitutional and criminal law is disclosed by U.S. Pat. No. 4,012,045 to Vail using a board having a continuous path of spaces around the outer edge of the board. The game includes up to five sets of cards relating to different facets of law, including indictment cards, defense cards, stop & frisk cards, evidence cards and Search Warrant cards. Each player initially receives one indictment card charging them with a crime which the player attempts to defend against by accumulating juror pieces as rewards as the player moves around the board.

U.S. Pat. No. 3,966,211 to Brown discloses a board game having a series of space designating locations, player markers, a spinning randomizer, a set of destination cards and a set of court cards, and play money. Players first take a destination card to determine their goal. Then, using the randomizer, the players attempt to reach their destination without being forced to draw a Court card which penalizes the player for a traffic infraction. The winner is the player to arrive first at their destination without being fined, or the remaining player if all other players have gone bankrupt from fines.

U.S. Pat. No. 3,850,433 to Purlia teaches a game relating to the process for obtaining a patent in which a playing board has a continuous path around the board edges divided into spaces, markers for identifying each player, a randomizer in the form of a spinning wheel, and two sets of cards. One set of cards comprises concept cards, while the other set are search cards. The corner spaces of the board are marked home, patent office, manufacturing plant and patent office review. The remaining spaces are marked either patent attorney, manufacturing plant or concept. When a player lands on a concept space, they draw a concept card and when they subsequently land on a patent attorney space, they draw a search card to determine the patentability of their concept card. The game has provision for players to exploit their patents and receive royalties from other players as they move around the board, similar to MONOPOLY. The player is not given the option to appeal the result of the search card, and the players continue around the board until all but one player is bankrupt.

A board game having two player movement areas simulating initiation and resolution of malpractice claims is disclosed by U.S. Pat. No. 4,068,848 to Lichtman et al. The board has an outer continuous path of spaces around the outer edge of the board, and an inner column of spaces representing stages of a lawsuit. Each of four professions that can be represented by players has its own deck of cards for outcomes relating to fictional services provided by the player representing that profession. If the outcome is bad, then the player may commence a lawsuit against the player representing the professional accused of malpractice. A separate stack of Verdict cards are used to determine the outcome of any lawsuit started against a player's professional alter ego. The players involved in the lawsuit can seek settlement at any time until the final Verdict is revealed from the cards, representing jury votes, that each player has. The game does not include an appeals process.

U.S. Pat. No. 4,039,192 to Magiera describes a trial procedure-related combined card and board game in which cards accumulated by moving around a path on the board during a first phase of the game are played against each other in a second phase of the game. In the second, or trial, phase of the game, legal maneuver and objection cards are played by each player to win card hands.

A game having a linear board game path based on stock market concepts is taught by U.S. Pat. No. 6,189,886 to Moran. The path is arranged as a series of columns across the board divided into spaces of different colors. The game includes a set of market flash news cards, a set of stock cards and a set of price cards. Each player is represented by a marker, and play money is provided. One player acts as the Banker for the game and oversees transactions. The winning goal is set by the players, but the goal can be to have the most money at the end of the game.

The remaining patents disclose other board games involving money and randomized movement along a path on a board, but which are distinguishable from the invention, and they are enclosed for general reference.

SUMMARY OF THE INVENTION

The game of the present invention includes a board inscribed with columns and arranged to form a path divided into spaces or boxes, a plurality (i.e. eight) of mutually distinguishable player markers (each having a different color, for example), a number (three) of sets of cards, randomization means (i.e. one or two six-sided dice) and play money of varying denominations.

The three sets of cards are: Bring A Lawsuit or simply Lawsuit cards, Appeal cards and Settlement cards. Some of the spaces on the board bear instructions for a player to pay money or receive money. Other spaces instruct a player to draw a Lawsuit card.

To play the game, two or more players each select one of the player markers, which are preferably shaped as a gavel of different colors, place their markers at the start of the path on the board (e.g. on a box marked "Start") and receive a sum of play money (e.g. $5,000). One person is selected to be the Banker to control the payment and receipt of the play money during the game.

The players throw one or both dice or use a spinner to determine the order of play, followed by each player in turn rolling one die, moving their marker a corresponding number of spaces (between one and six where a conventional six sided die is used) and following the instructions on the space reached by the player.

If the space instructs the player to pay or receive money, the transaction is performed with the Banker and the fund of play money, and the die is passed to the next player for their turn.

If the space instructs the player to take a "Bring A Lawsuit" card , they draw the first card from the top of the Lawsuit card pile. The Bring A Lawsuit or Lawsuit cards each contain an outcome of a legal action which calls for the player to collect or pay money from or to the Banker or fund. If the player is not satisfied with the amount collected from the outcome on the Lawsuit card (which may be as little as zero or where the card directs a player to "roll again"), the player may draw an Appeal card. The Appeal card contains instructions for changing the amount of money collected by the player, either up or down, or does not alter the Lawsuit card result.

Upon each turn after the player's first turn, he or she may elect to take a Settlement card instead of rolling the dice. Each Settlement card contains instructions for paying or collecting money to or from the fund.

Once a player has at least $20,000 of play money, they can pay $20,000 to the Banker to become a "partner", thereby doubling the amounts either collected or paid during subsequent play, according to the instructions on board spaces and the cards. Thereafter, the player may also "cash out" at any time and receive his/her $20,000 back and all money amounts are thereafter returned to their original value for further play.

The players continue to roll the die, take cards and move their markers until they reach the end of the path. Players who reach the end of the path before the others take a Settlement card instead of rolling the die upon each subsequent turn, until the last player has reached the end. The players then total their play money and the winner is the player who has accumulated the most money.

By careful use of Lawsuit, Appeal and Settlement card scenarios, a wide variety of legal situations can be described in a manner that is particularly tailored to children. This maintains the child's interest while, at the same time, revealing to the child the potentials and risks for gain and loss that depend on the course followed, the selections made and even on luck. A comprehensive listing of the content of the cards is included in the detailed description of the invention to illustrate this feature of the invention.

Instead of education, the cards and spaces may be designed for other specialized legal entertainments, e.g. simulating medical malpractice law or other types of law.

The game board also includes other spaces that are instructive such as spaces early in the sequence that deal with law school education, law clerking, and the bar exam, later spaces reflecting various successes and failures of the player in his or her capacity as a lawyer, and spaces dealing with various other management and administrative responsibilities faced by many lawyers such as paying office rent, buying furniture and the like.

Accordingly, an object of the invention is to provide an educational and legal profession-based board game for play by a plurality of players, comprising: a game board containing a series of spaces on which each player can land, the spaces including a first plurality of spaces instructing a player to bring a simulated lawsuit and a second plurality of spaces instructing a player to act as a result of a simulated circumstance associated with the legal profession; a fund of play money; randomization means for randomly determining a number of spaces on the game board to be moved by each player; and a set of lawsuit cards each having thereon a lawsuit scenario including a fact pattern and a positive or negative monetary result. A player who lands on one of the first plurality of spaces takes a lawsuit card which results in either paying into the fund of play money, a negative result of the taken lawsuit card, or drawing from the fund of play money, a positive monetary result of the taken lawsuit card. A player landing on one of the second plurality of spaces acts in accordance with the simulated circumstance described on the second space landed upon.

A further object of the invention is to provide the game with a set of Appeal cards each having thereon an appellate level legal scenario. A player who takes a Lawsuit card has an option of taking an Appeal card and thereafter complying with the appellate level scenario thereon.

A still further object of the invention is to provide the game with a set of Settlement cards each having thereon a settlement scenario for a legal dispute, a player having an option of taking a Settlement card and complying with the settlement scenario at selected times during play of the game.

Another object of the invention is to provide a method of playing a legal based and educational board game.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings the only FIGURE is a top plan view of a game board of the present invention.

DESCRIPTION OF THE PREFERRED EMBODIMENTS

The drawing illustrates the game board 10 of a preferred embodiment of the invention. Although the board may have any number of spaces and still fall within the scope of the invention, in the embodiment illustrated the game board has 62 spaces arranged in a sequence and starting from an initial space 14 labeled "Open your own practice" or simply START. The last space 16 in the sequence is labeled "Are you Trial Attorney Of The Year?" or simply FINISH.

The sequence is laid out in any desired manner.

A serpentine path is illustrated in the figure but a rectilinear or curved spiral or other shaped path may be used. Also, although according to the preferred rules for playing the game, the sequence has a start and a finish, the invention may also use a closed (that is, an endless) path without departing from the principles of the invention.

In the embodiment illustrated the path of spaces goes up and down around four columns of a simulated court house illustrated on the board.

Two to eight players each select a differently colored gavel charm or token 20 to use as their individual place holder on the board. A selected amount of play money, e.g. $5,000, is initially given to each player from a fund of play money by a player selected to be the Banker.

The series of spaces on the game board include a first plurality of like spaces 11 labeled "Bring A Lawsuit." If a player lands on such a space during his or her turn at play, the player must bring a simulated lawsuit by selecting the top card from a stack of "Bring A Lawsuit" or "Lawsuit" cards and follow the instruction printed on the taken card. The board illustrated has 22 such lawsuit spaces 11, distributed randomly in the series of spaces. The Lawsuit cards 30 are stacked on an area, for example, at the top of the board 10.

The game board also includes a second plurality of spaces 12 each instructing a player to act as a result of a simulated circumstance or scenario associated with the legal profession. There are, for example, 38 such spaces. Early in the series of spaces, for example, the second type of spaces 12 contain circumstances involving education, training and licensing (i.e. taking the bar exam). Later spaces 12 involve paying for furniture, rent, employees, experts and the like, which illustrate other aspects of the legal profession.

The game also includes the fund of play money 22 in various denominations, such as stacks of fake bills for $250, $500, $1,000, $5,000 and $10,000. Randomization means such as a one or two dice 24, a spinner or other mechanism for randomly generating small numbers, is included as part of the game equipment. These means are initially used by each player and the player getting the largest number goes first. Each player starts at the "Start" space and takes his or her turn using one die, the spinner or the like, to randomly determine the number of spaces on the game board he/she is to move.

The inventor has found that a one 6-sided die is useful for play by each player, in view of the number of spaces 11 and 12, and the resulting length and complexity of play.

Upon each turn, each player takes the action called for each space on which they land. If the player lands on a "Lawsuit" space 11, a Lawsuit card is taken from that stack of cards 30. Each Lawsuit card has printed thereon a lawsuit scenario including a fact pattern and a positive or negative monetary result. The player then has the option of complying with the monetary result by either paying into the fund of play money, a negative result of the Lawsuit card taken, or receiving from the fund of play money, a positive monetary result of the Lawsuit card taken. A player landing on one of the second type of cards 12 must act in accordance with the simulated circumstance of that space, which often, but not always, involves paying money or being paid money from the fund.

For good order, the Banker is called on to pay out from, or receive play money to, the fund.

Any player who lands on a Lawsuit space and takes a Lawsuit card may, instead of complying with the monetary directive of the taken card, at his or her option, take an Appeal card from a stack of such cards 32. Each Appeal card has printed thereon an appellate level scenario for a lawsuit. The player who has opted to appeal must then comply with the appellate level scenario, which may involve paying more money or receiving more money.

A still further part of the game equipment is a set of Settlement cards in a stack 34, each having printed thereon a settlement scenario for a legal dispute. After each player has taken at least one initial turn with the die, he/she may take a Settlement card instead of taking any subsequent turn. The player must then comply with the settlement scenario, which may also require paying money to, or receiving money from, the fund of play money.

For even greater interest and to provide the players with additional insight into at least some types of legal careers, for a selected buy-in amount of money paid by a player into the fund, e.g. $20,000, the player may become a "Partner." The effect is that all subsequent monetary results, whether positive or negative, and whether from any type of card or from a space 12, are doubled. The "Partner" player may subsequently leave the partnership and recover his or her $20,000. The monetary results for each space or card draw then return to their original face value.

Eventually all players will reach the last space 16, FINISH or "Are you Trial Attorney Of The Year?" As each successive player arrives and there waits for the other players, he/she takes a Settlement card during each of his/her subsequent turns. Upon the last player reaching the last space, 16 the game ends. The last player reaching the last space does not draw a Settlement card.

The winner is the player with the most play money after all players have reached the final space. That player is bestowed with the title "Trial Attorney Of The Year."

Following is an exemplary list of the spaces, 11, 12, 14, and 16, in their correct sequence:

Open your own practice or START here.

You are a college graduate planning to go to law school. Pay $10,000 for next year's tuition.

You are a law student. Pay $12,000 for this year's tuition.

You got a scholarship to attend Wittlin School of Law in Chester, Pa. Collect $10,000.

You graduated from law school and were offered a job at a law firm as an associate attorney. Collect $10,000.

You were invited to work as a law clerk at your State Supreme Court for the summer. Collect $1,000.

Pay $1,000 to sit for the bar exam to become a lawyer.

Plaintiff brought a lawsuit and lost. Judgment was for the defendant. Collect nothing.

Bring a lawsuit

Bring a lawsuit

Bring a lawsuit

Your client is now disabled and cannot return to work. Collect $5,000 in disability benefits for your client.

You worked very hard on papers you submitted to a judge on behalf of your client. Collect $4,000 in fees.

Bring a lawsuit

Collect $2,000 in legal fees.

Purchase office supplies. Pay $1,000.

You need to purchase new office equipment. Pay $5,000.

Take continuing education classes in employment law. Pay $1,000.

Your client was found sleeping on the job. Unemployment benefits were denied. Collect nothing.

Your client was injured on the job. Collect $8,000 in worker's compensation benefits for him.

Bring a lawsuit

Bring a lawsuit

Pay your attorney registration fee of $500.

Plaintiff brought a lawsuit and lost. Judgment for the defendant. Collect nothing.

You represented Little Alex pro bono (for no fee) against a claim of assault with a water gun. Pay $5,000 in costs.

Purchase new law books for your office library. Pay $5,000.

Bring a lawsuit

You have been found tampering with court papers. Pay a fine of $5,000.

Bring a lawsuit

Bring a lawsuit

Bring a lawsuit

Hire a secretary to assist you in the office. Pay $3,000.

Your telephone bill is due. Pay $500.

Bring a lawsuit

You were sanctioned by the court for deliberately harassing your opposing counsel. Pay a fine of $2,000.

Bring a lawsuit

Bring a lawsuit

One of your clients decided to go to another lawyer. Work on a different file. Roll again.

Hire a secretary to help organize your files. Pay $3,000.

Your law firm lured a top lawyer away from another firm. Collect $10,000.

Bring a lawsuit

You need to purchase new furniture for your office. Pay $3,000.

Bring a lawsuit

Bring a lawsuit

Pay your office rent of $2,500.

You were suspended from practicing law. Lose one turn.

Your son's teacher referred you a new client, but the client hired someone else. Roll again.

You've just gotten a great new client. Collect $6,000.

You need to file a complaint against defendant, Samodida, Inc. Pay the court filing fee of $500.

Bring a lawsuit

Bring a lawsuit

You took a trip to the United States Supreme Court in Washington, D.C. to argue a case on free speech. Pay $500 in expenses.

Bring a lawsuit

It took two weeks to pick a jury. Collect $5,000 in fees.

Sign a new lease for office space. Pay $5,000.

Bring a lawsuit

Hire a paralegal to assist you at work. Pay $1,000.

Ask a nurse expert to review medical records to determine whether the plaintiff is seriously injured. Pay $2,500.

Bring a lawsuit

Pay your expert witness $3,000 to assist you in your case.

Bring a lawsuit

Are you "Trial Attorney Of The Year"? or FINISH.

Following is a list of the Bring A Lawsuit or simply the Lawsuit cards which, like the Appeal and Settlement cards have legal scenarios that were written to be educational but also entertaining, particularly for children that are five years old or older:

Your client slipped on a grape at the supermarket. She sued the grocery store chain (the defendant) and the jury found in her favor. Collect $3,000 on her behalf.

The wipers on a bus were going "swish, swish, swish" when one wiper, improperly attached, flew off the bus and cracked another car's windshield. Your client, the driver of the car (the plaintiff), sued the bus company (the defendant) and won. Collect $500 on your client's behalf.

Your client engaged a builder to construct a house made out of candy. Instead the builder used wood. Your client (the plaintiff) sued the builder (the defendant). The jury found for the plaintiff. Collect $10,000 on his behalf.

You represent a toy manufacturing company. It sued the seller of a defective machine-instead of making toy soldiers, it made toy princesses. Collect $8,500.

Your client was injured in a race car accident when another car hit him. He hurt his big toe. He sued and the jury found in his favor. Collect $3,000 on his behalf.

One little monkey jumped on his bed. The bed collapsed and he bumped his head. His owner called the doctor and the doctor said, "Sue the manufacturer of that defective bed." He did and won. Collect $1,000.

Your client, Tina (the plaintiff), sued her surgeon (the defendant) after finding a paper clip was left in her abdomen during a hernia operation. The jury held for the plaintiff. Collect $5,000 on her behalf.

You represent the landlord (the plaintiff) of a doghouse who alleged his tenant's owner (the defendant) owed her 5 months in back rent. The jury agreed. Collect $5,000 for the plaintiff.

Your client, a clown, got hurt when a child at a party squeezed his red nose too hard. He has been disabled from work ever since. Collect $2,000 in workers compensation benefits on his behalf.

Your client, Cameron, sued Maxwell for intentional inflection of emotional distress, after Maxwell dressed up for a Halloween party as Cameron (looking just like him) and scared him. Cameron sued and was awarded $2,000. Collect on your client's behalf.

You represent a zookeeper (the plaintiff) who sued her employer (the defendant) after being fired for keeping the zoo open an extra 15 minutes for kids visiting from the local public school. The jury found for the plaintiff. Collect $8,000 on your client's behalf.

Your client, Princess Rebecca, sued King David for defamation, since he proclaimed (wrongly) that she was not a "true" princess. The jury found for the Princess and awarded her $2,000. Collect on her behalf.

Your client, Super Hero, sued Loser after Loser dressed up like Super Hero and pretended to be him at the park as he grabbed balls away from 1st graders. Collect the jury's award of $8,000 on your client's behalf.

Every day after Sarah and Lauren (the plaintiffs) left for work, Nathaniel, Alexander and Caroline walked onto their property and yanked the flowers from their garden. The plaintiffs sued for "trespass to land" and won. Collect $2,000 on their behalf.

Your client sued Giggle Club, Inc. for fraud, claiming the Club promised their candies would make children giggle-but instead they just made them "hyper." The jury awarded your client $2,000. Collect this award on your client's behalf.

Mr. Talkative divulged your client's trade secret on how to make books out of candy. (You read the book, then eat it. The more you read, the more you eat.) Your client sued and the jury awarded her $10,000. Collect on her behalf.

Your client, Sean Thomas, sued Lost Horizons Airlines for taking him to New Jersey instead of California to visit Disneyland. The jury awarded him $2,000. Collect on his behalf.

Betsy sued her friend Elizabeth (for invasion of privacy) after Elizabeth took Betsy's diary home and read it to her brother and sister. The jury awarded Betsy $1,000. Collect it on her behalf.

Your client, James, sued Isabelle for intentional inflection of emotional distress after she grabbed his favorite toy race car and hurled it across the room, breaking one of its windows. The jury awarded James $500. Collect the award on his behalf.

Your client, Adam (the plaintiff), sued Marc (the defendant), after Marc rode his bicycle into him while he was talking on his walkie-talkie and not paying attention to the sidewalk. The jury awarded Adam $500. Collect on his behalf.

Daniel sued Alison for divorce after she broke his ceramic artwork. (In pre-school they had a "pretend marriage ceremony.") The jury awarded alimony of $1,000. Collect on his behalf.

Sophia took a doll from Kelly at school, put it in her lunch box and brought it home. She dressed it in new clothes, and painted its blonde hair brown. After Kelly recognized her doll at Sophia's house, she decided to sue for "conversion". The jury awarded Kelly (the plaintiff) $500. Collect it on her behalf.

Eve, at 10 years old, became a famous child star. She had a beautiful opera voice that captivated audiences. She earned a huge salary, but forgot to pay taxes on her income. The government sued her for past taxes and won. Pay $5,000 to the government.

The singing group, Nat, Alejandro and Bianca (the plaintiffs) wrote a song, "Three Little Babies Up In the Sky." Before they recorded the song on a CD, the "Stealers," (another singing group), claimed it as their own. The plaintiffs sued and won $5,000. Collect the amount on their behalf.

Jonathan and Jordan were playing super heroes. Jordan was the villain and locked Jonathan in the closet. Jonathan (the plaintiff) sued Jordan (the defendant) for false imprisonment. The jury awarded Jonathan $1,000. Collect on his behalf.

Patrick had a tree house in his backyard. Emily, his next door neighbor, wanted to use it. Patrick agreed so long as she paid him $100 a month. She agreed. After using the house for 15 months, she refused to pay up. Patrick (the plaintiff) sued Emily (the defendant) and won. Collect $1500 on your client's behalf.

Ernestina was a beautiful 7 year old. One day a man at the park who worked for Miller Milk Industries took her picture because she looked so precious as she drank his company's milk. The man gave the picture to his boss, who loved it, and decided to use the photo on billboards to advertise the company's milk product. Ernestina sued for invasion of privacy and won. Collect $5,000 on her behalf.

Bridget went to her girlfriend Beverly's house for a playdate, but refused to leave when Beverly had to do her homework. Beverly sued Bridget for trespass to land and won. Collect $500 on her behalf.

The Appeal cards are, for example:

The Appellate Court hereby provides that the jury's award is vacated. Judgment for the defendant. Pay back all money received.

The Appellate Court hereby provides that the jury awarded an excessive amount in damages to the plaintiff. Return half of the money you collected.

Mistakes were made during trial. This case needs to be re-tried. Collect nothing, but you can roll again.

The Appellate Court hereby provides that your client is entitled to an additional $5,000.

The Appellate Court hereby provides that your client is entitled to an additional $10,000.

The Appellate Court hereby provides that your client is entitled to an additional $15,000.

The Appellate Court hereby provides that your client is entitled to receive twice the amount the jury awarded.

The Settlement cards are, for example:

You represent a plaintiff in a lawsuit. The defendant agreed to pay your client $500 to avoid a trial. Collect $500.

You represent a plaintiff in a lawsuit. The defendant agreed to pay your client $1,000 to avoid a trial. Collect $1,000.

You represent a plaintiff in a lawsuit. The defendant agreed to pay your client $2,000 to avoid a trial. Collect $2,000.

You represent a plaintiff in a lawsuit. The defendant agreed to pay your client $3,000 to avoid a trial. Collect $3,000.

You represent a plaintiff in a lawsuit. The defendant agreed to pay your client $4,000 to avoid a trial. Collect $4,000.

You represent a plaintiff in a lawsuit. The defendant agreed to pay your client $5,000 to avoid a trial. Collect $5,000.

You represent a defendant in a lawsuit. Your client has agreed to pay the plaintiff $500 to avoid a trial. Pay $500.

You represent a defendant in a lawsuit. Your client has agreed to pay the plaintiff $1,000 to avoid a trial. Pay $1,000.

You represent a defendant in a lawsuit. Your client has agreed to pay the plaintiff $2,000 to avoid a trial. Pay $2,000.

You represent a defendant in a lawsuit. Your client has agreed to pay the plaintiff $3,000 to avoid a trial. Pay $3,000.

You represent a defendant in a lawsuit. You client has agreed to pay the plaintiff $4,000 to avoid a trial. Pay $4,000.

You represent a defendant in a lawsuit. You client has agreed to pay the plaintiff $5,000 to avoid a trial. Pay $5,000.

The parties were unable to agree on a settlement. Collect nothing and lose a turn.

Each of the card types may be labeled on the top with the same label or symbol, e.g. "Bring A Lawsuit" with the "scales of justice" symbol. The opposite side carries the text and the stacks are arranged on or near the board, face down, e.g., on stack areas 30, 32 and 34.

While a specific embodiment of the invention has been shown and described in detail to illustrate the application of the principles of the invention, it will be understood that the invention may be embodied otherwise without departing from such principles.

What is claimed is:

1. A method of playing an educational and legal profession-based board game for a plurality of players, comprising the steps of:

providing a game board containing a series of spaces on which each player can land, the spaces including a first plurality of spaces instructing a player to bring a simulated lawsuit and a second plurality of spaces instructing a player to act in accordance with a simulated circumstance associated with the legal profession, the second plurality of spaces including at least one space associated with simulated circumstances involving at least one of simulated legal education, simulated legal training and simulated legal licensing of the player;

providing a fund of play money;

providing a set of lawsuit cards each having thereon a lawsuit scenario including a fact pattern and a positive or negative monetary result;

randomly determining a number of spaces on the game board to be moved by each player in turn, for each player to land on a space on the board;

a player landing on one of the first plurality of spaces taking a lawsuit card and having an option of complying with the monetary result by either paying into the fund of play money a negative result of the taken lawsuit card, or drawing from the fund of play money a positive monetary result of the taken lawsuit card;

a player landing on one of the second plurality of spaces acting in accordance with the simulated circumstance of the one of the second spaces landed upon including acting in accordance with at least one of the simulated legal education, simulated legal training and simulated legal licensing of the player:

providing a set of settlement cards each having thereon a settlement scenario for a legal dispute, the method including a player taking a settlement card and complying with the settlement scenario on the taken settlement card at selected times during play of the game;

at least some of the settlement cards having thereon a settlement scenario involving a player paying play money to or receiving play money from the fund; and including a player paying a selected amount of buy-in play money to the fund to become a simulated partner, and the player receiving and paying monetary results at a multiple of the amounts shown on the lawsuit cards and the settlement cards.

2. A method according to claim 1, including providing a set of appeal cards each having thereon an appellate level scenario for a lawsuit, a player who takes a lawsuit card as a result of landing on one of the first plurality of spaces having an option of taking an appeal card instead of paying to or drawing from the fund, and complying with the appellate level scenario on the taken appeal card.

3. A method according to claim 2, including a player taking a settlement card and complying with the settlement scenario on the taken settlement card at selected times during play of the game while staying on a current space for the player, instead of using the randomization means for randomly determining a number of spaces on the game board to be moved by the player from the current space.

4. A method according to claim 3, wherein the series of spaces includes one start space where play begins and one finish space where play ends, the method including beginning play at the start space and ending play at the finish space.

5. A method according to claim 4, wherein the second plurality of spaces includes at least one space associated with simulated circumstances involving with at least one of setting up, furnishing and maintaining a simulated legal practice of the player, the method including the player acting in accordance with at least one of the simulated circumstances involving at least one of setting up, furnishing and maintaining a simulated legal practice.

6. A game according to claim 1, wherein at least some of the second plurality of spaces require a player landing on these spaces to pay play money to the fund.

7. A method of playing an educational and legal profession-based board game for a plurality of players, comprising the steps of:

providing a game board containing a series of spaces on which each player can land, the spaces including a first plurality of spaces instructing a player to bring a simulated lawsuit and a second plurality of spaces instructing a player to act in accordance with a simulated circumstance associated with the legal profession;

providing a fund of play money;

providing a set of lawsuit cards each having thereon a lawsuit scenario including a fact pattern and a positive or negative monetary result;

randomly determining a number of spaces on the game board to be moved by each player in turn, for each player to land on a space on the board;

a player landing on one of the first plurality of spaces taking a lawsuit card and having an option of complying with the monetary result by either paying into the fund of play money a negative result of the taken lawsuit card, or drawing from the fund of play money a positive monetary result of the taken lawsuit card;

a player landing on one of the second plurality of spaces acting in accordance with the simulated circumstance of the one of the second spaces landed upon; and a player paying a selected amount of buy-in play money to the fund to become a simulated partner, and the player receiving and paying monetary results required at a multiple of the amounts shown on the lawsuit cards.

8. A method according to claim 7, including providing a set of appeal cards each having thereon an appellate level scenario for a lawsuit, a player who takes a lawsuit card as a result of landing on one of the first plurality of spaces having an option of taking an appeal card instead of paying to or drawing from the fund, and complying with the appellate level scenario on the taken appeal card.

9. A method according to claim 7, including providing a set of settlement cards each having thereon a settlement scenario for a legal dispute, the method including a player taking a settlement card and complying with the settlement scenario on the taken settlement card at selected times during play of the game.

* * * * *